US006209762B1

(12) United States Patent
Haffner et al.

(10) Patent No.: US 6,209,762 B1
(45) Date of Patent: Apr. 3, 2001

(54) DISPENSING PACKAGE AND METHOD OF USE

(75) Inventors: Eugene F. Haffner, Waterville; Douglas S. Struble, Maumee; Robert A. Myers, Perrysburg, all of OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 09/443,828

(22) Filed: Nov. 19, 1999

Related U.S. Application Data

(63) Continuation-in-part of application No. 09/015,517, filed on Jan. 29, 1998, now abandoned.

(51) Int. Cl.[7] ..... B65D 25/40
(52) U.S. Cl. ..... 222/570; 222/571
(58) Field of Search ..... 222/570, 109, 222/571

(56) References Cited

U.S. PATENT DOCUMENTS

| | | |
|---|---|---|
| 826,226 | 7/1906 | Burton . |
| 1,996,533 | 4/1935 | Weickel . |
| 2,780,398 | 2/1957 | Frey . |
| 3,397,824 | 8/1968 | Ganung et al. . |
| 4,696,416 | 9/1987 | Muckenfuchs . |
| 4,706,829 | 11/1987 | Li . |
| 4,726,478 | 2/1988 | Zimmerman . |
| 4,773,560 | 9/1988 | Kittscher . |
| 5,060,827 | 10/1991 | Segati . |
| 5,114,659 | 5/1992 | Krall . |
| 5,207,356 | 5/1993 | Krall . |
| 5,649,650 | 7/1997 | Klauke . |
| 5,794,803 | 8/1998 | Sprick . |

*Primary Examiner*—Philippe Derakshani

(57) ABSTRACT

A container assembly that includes a container having a body with a cylindrical neck and an integral lug projecting radially inwardly from the neck. A fitment has a cylindrical wall adapted to be received within the container neck. The fitment wall has internal threads for receiving a container cap, and an axial slot adapted to be received by snap fit over the lug in the container neck. The neck lug thus cooperates with the slot in the fitment wall for both retaining the fitment axially within the neck, and preventing circumferential rotation of the fitment within the neck. The fitment and cap are provided to a packager as a subassembly separate from the container. The container is rapidly filled with product through the relatively large opening in the container neck, and the cap/fitment subassembly is then snapped into the container neck to complete the package assembly.

32 Claims, 2 Drawing Sheets

DISPENSING PACKAGE AND METHOD OF USE

This application is a continuation-in-part of application Ser. No. 09/015,517 filed Jan. 29, 1998 now abandoned.

The present invention is directed to packages for containment and dispensing of flowable products such as liquid detergent, and more particularly to a container and finish fitment assembly for such a package.

BACKGROUND AND OBJECTS OF THE INVENTION

Product containment and dispensing packages have been proposed, in which the container includes a body with an integral neck and a separate fitment assembled to the neck for restraining and channeling product flow during dispensing. The closure, which may also function as a measurement cup, has threads that engage the container neck or fitment for sealing the package. Liquid laundry products are common examples of this type of packaging. Packages of the described character are illustrated, for example, in U.S. Pat. Nos. 5,114,659 and 5,207,356. It is conventional practice with containers and packages of this character to secure the fitment to the container neck at the time of container manufacture, such as by welding or other securement techniques. The container/fitment subassembly and the closure cap are then shipped as separate units to the packager. The packager must fill the container with product through the relatively small opening in the fitment that is designed primarily to restrain and guide flow during dispensation. The closure is threaded onto the container neck or fitment by the packager after the product is placed in the container.

It is a general object of the present invention to provide a container and fitment arrangement in which the fitment may be secured to the container without requiring a separate welding or other joining operation. Another object of the present invention is to provide a container and fitment assembly, and a container package and method of use, in which the fitment may be assembled to the container after the container is filled with product, such that the container may be more rapidly filled through the relatively large opening in the container neck prior to assembly of the fitment to the container. A further object of the present invention is to provide a container/fitment package and method of use that satisfy the objective set forth immediately above, and in which the fitment and closure may be readily and rapidly assembled to the container following filling of the container.

In accordance with one aspect of the present invention, there is provided a container assembly that includes a container having a body with a cylindrical neck and an integral lug projecting radially inwardly from the neck. A fitment has a cylindrical wall adapted to be telescoped within the container neck. The fitment wall has internal threads for receiving a container cap, and an axial slot adapted to be received by snap fit over the lug in the container neck. The neck lug thus cooperates with the slot in the fitment wall for both retaining the fitment axially within the neck, and preventing circumferential rotation of the fitment within the neck. In the preferred method of use in accordance with another aspect of the invention, the fitment and cap are provided to a packager as a subassembly separate from the container. The container is rapidly filled with product through the relatively large opening in the container neck, and the cap/fitment subassembly is then snapped into the container neck to complete the package assembly.

In the preferred embodiments of the invention, the fitment includes an annular wall that extends radially inwardly from an end of the fitment cylindrical wall and disposed in assembly between the internal threads on the fitment and the container body. This annular wall may be conical, tapering narrowingly in assembly into the container body, or flat and perpendicular to the axis of the neck, or flat and angulated with respect to the axis of the container neck. In one embodiment, the annular fitment wall defines a keyhole-shaped opening with a central circular portion and a radial portion that extends from the central portion to the fitment cylindrical wall. The internal threads on the fitment wall are interrupted in alignment with the keyhole-shaped opening to facilitate dispensation of product. In other embodiments, a conical pour spout integrally axially extends from the annular wall within the cylindrical wall of the fitment. The spout has a central axis that may be either concentric with or offset from the axis of the fitment cylindrical wall.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 3:
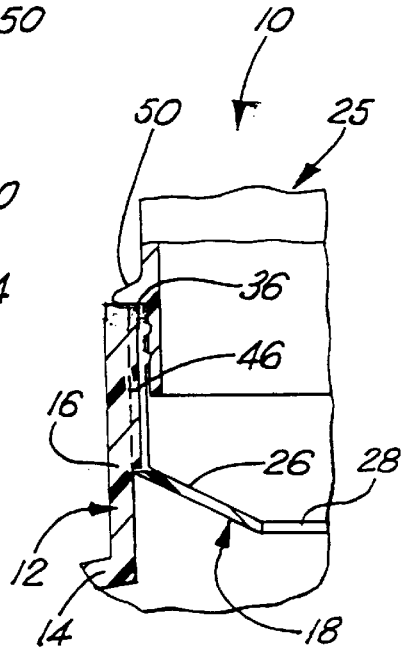
FIG. 3 is a fragmentary sectional view on an enlarged scale of a portion of the package illustrated in FIG. 1.
Figure 4:
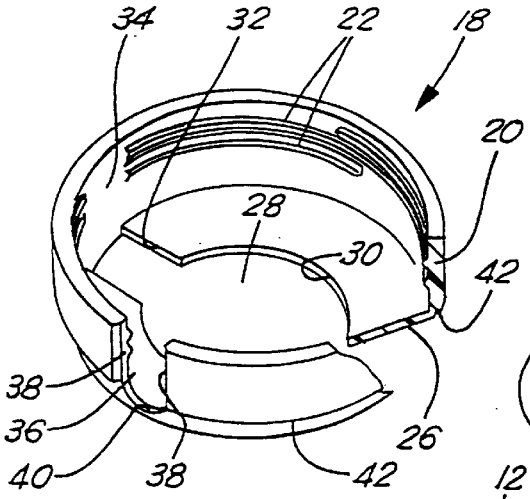
FIG. 4 is a perspective view of the fitment in the package of FIGS. 1–3.

FIGS. 1–4 illustrate a product containment and dispensing package 10 in accordance with one presently preferred embodiment of the invention. A container 12 has a hollow body 14 from which a cylindrical neck 16 axially extends surrounding and defining the fill/dispensing opening of the container. A fitment 18 is axially telescopically received and secured with neck 16. The fit between fitment 18 and neck 16 is preferably a close sliding fit. Fitment 18 includes a cylindrical wall 20 having internal threads 22 for receiving a package closure 24. A conical wall 26 extends from the lower edge of cylindrical wall 20, and tapers narrowingly toward the inside of container neck 16 and body 14. The inner edge of wall 26 defines a keyhole-shaped opening 28 having an enlarged circular portion 30 coaxial with fitment wall 20, and a second portion 32 that extends radially outwardly to the inner surface of wall 20. As best seen in FIG. 4, internal threads 22 are interrupted at 34 in axial alignment with dispenser opening portion 32 so that the product may flow freely from within the container. A radially opening and axially extending slot 36 is formed in fitment wall 20 at a predetermined position with respect to thread interruption 34 and opening portion 32. In the illustration of FIGS. 1–4, slot 36 is positioned 90° counterclockwise from thread interruption 34 and opening portion 32. Slot 36 is defined by a pair of parallel axially extending and circumferentially opposed side edges 38, and an arcuate or rounded bottom edge 40. Fitment 18 also has an axially facing shoulder 42 at the lower edge of wall 20 radially outwardly adjacent to conical wall 26.

Figure 1:
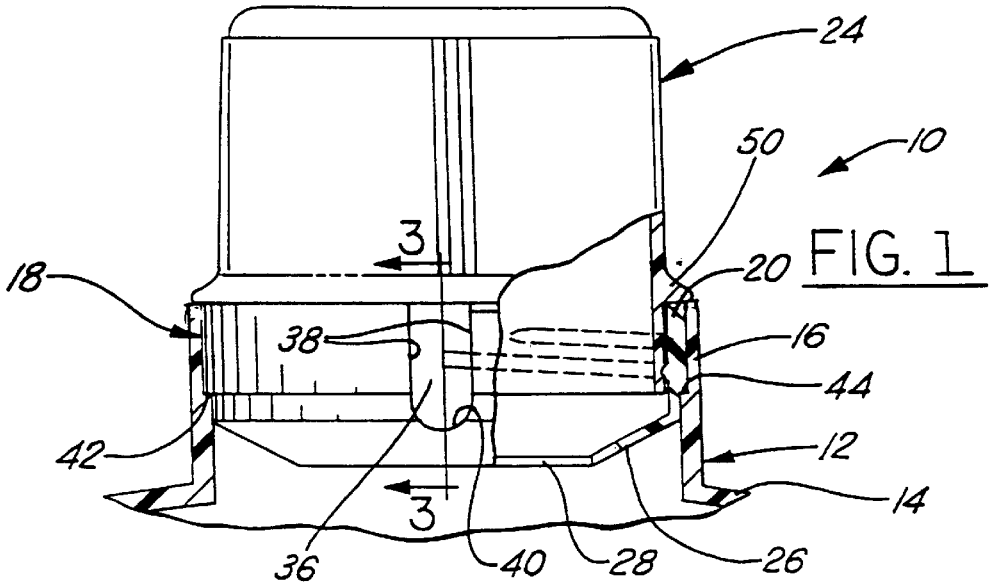
FIG. 1 is a fragmentary partially sectioned elevational view of a package assembly in accordance with one presently preferred embodiment of the invention.
Figure 2:
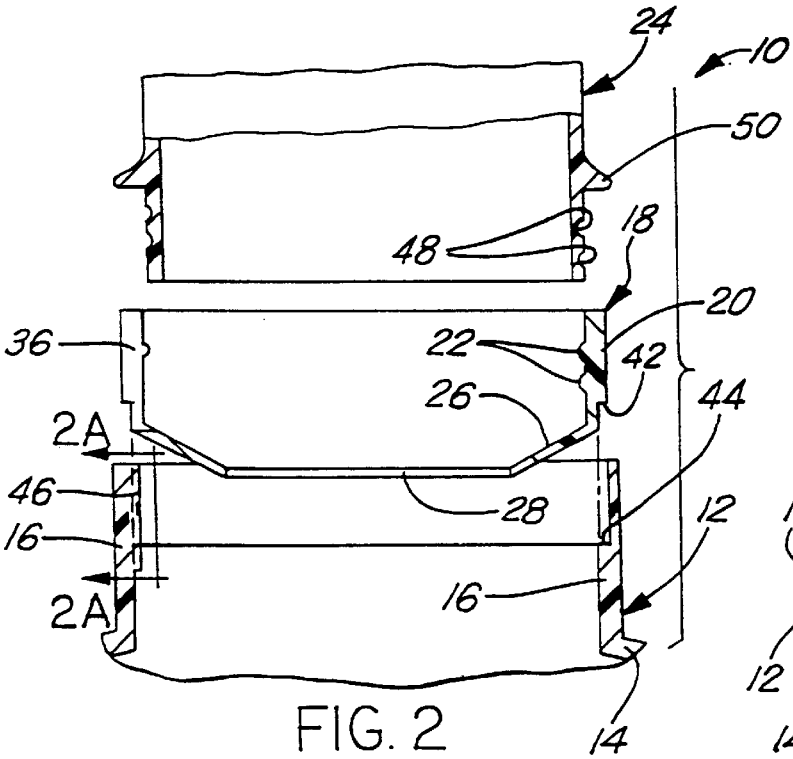
FIG. 2 is a fragmentary exploded elevational view of the package illustrated in FIG. 1.
Figure 2A:
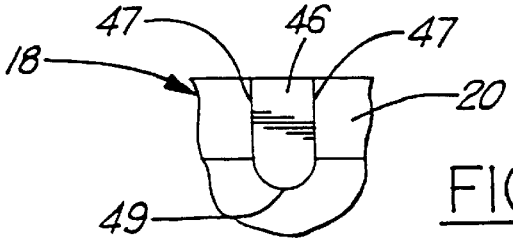
FIG. 2A is a fragmentary elevational view taken substantially along the line 2A—2A in FIG. 2.

Container neck 16 has an axially outwardly facing internal shoulder 44 against which fitment shoulder 42 seats in assembly. A U-shaped lug 46 projects radially inwardly from neck 16 for receipt by snap fit within slot 36 of fitment 18. Lug 46 has a pair of parallel side edges 47 (FIG. 2A) and an arcuate lower edge 49 complimentary to the contour of slot edge 40. The axial dimension of slot 36 and lug 46 is greater than the axial depth of shoulder 44 within neck 16 and shoulder 42 on fitment wall 20. Lug 46 is disposed at predetermined position within neck 16 coordinated with the external contour of container body 14. For example, lug 46 may be disposed at a position 90° clockwise with respect to the plane of the container handle, so that lug 46 in container neck 16 automatically cooperates with slot 36 in fitment 18 to orient and position opening portion 32 and thread interruption 34 opposite to the container handle. Closure 24 is of generally conventional cup-shaped construction, having an internal volume of predetermined size to measure an incremental amount of product dispensed from the container. Closure 24 has external threads 48 for receipt within fitment 18, and a radially outwardly projecting lip 50 for sealing engagement with the upper edge of neck 16, as best seen in FIGS. 1 and 3.

Figure 5:
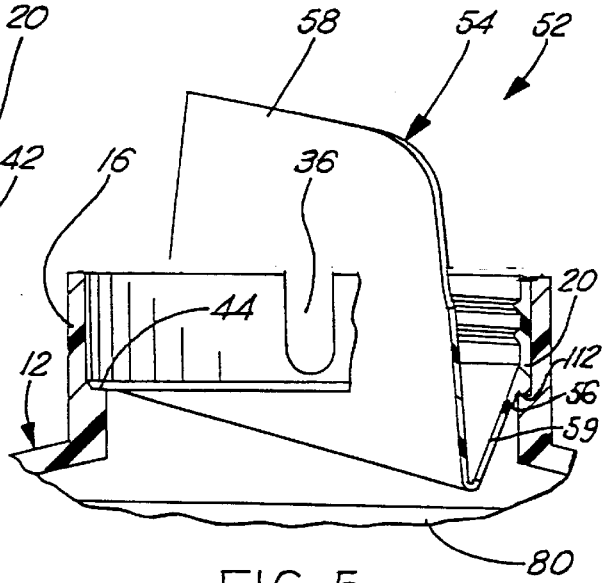
FIG. 5 is a fragmentary partially sectioned elevational view of a container assembly in accordance with a second embodiment of the invention.

FIG. 5 illustrates a container assembly 52 in accordance with a second embodiment of the invention, in which reference numerals identical to those employed in FIGS. 1–4 indicate identical components. Container assembly 52 in FIG. 5 features a modified fitment 54, in which the annular wall 56 that extends radially inwardly from fitment cylindrical wall 20 terminates in an outwardly extending conical spout 58. Spout 58 in this embodiment is coaxial with fitment cylindrical wall 20. Wall 56 includes a drain-back opening 59 for returning excess product to container 12.

Figure 6:
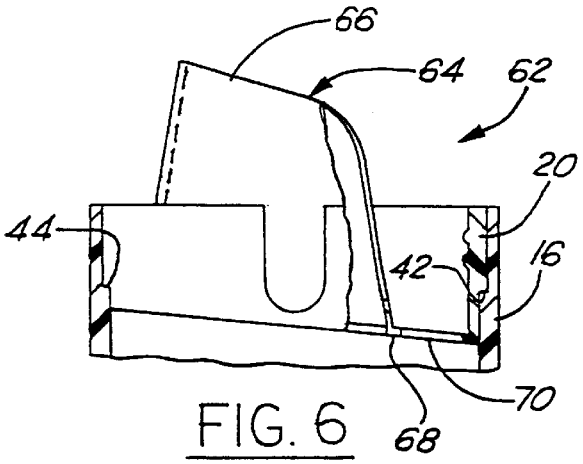
FIG. 6 is a fragmentary sectioned elevational view of a container assembly in accordance with a third embodiment of the invention.
Figure 7:
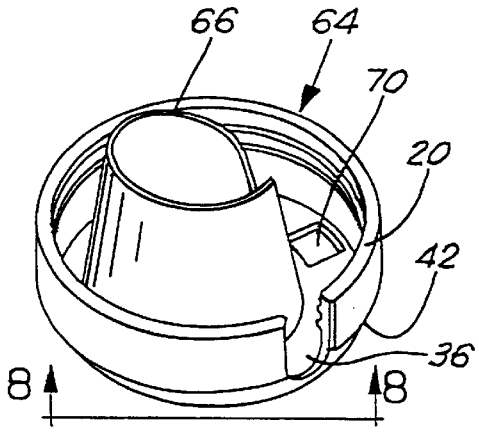
FIG. 7 is a perspective view of the fitment in the assembly of FIG. 6.
Figure 8:
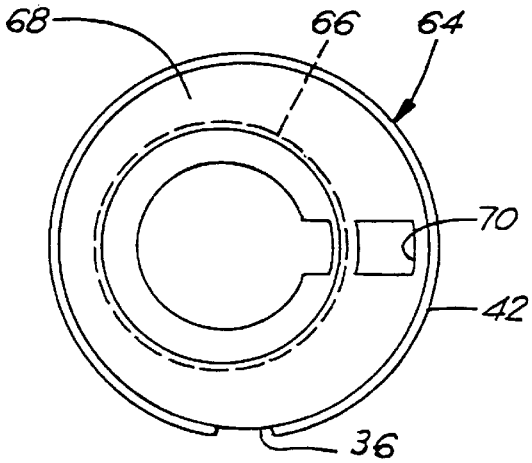
FIG. 8 is a bottom plan view of the fitment in FIG. 7, being taken substantially along the line 8—8 in FIG. 7.

FIGS. 6–8 illustrate a container assembly 62 in accordance with another embodiment of the invention, in which reference numerals identical to those employed in connection with previous embodiments again indicate identical components. Container assembly 62 features a fitment 64 that has an outwardly tapering conical spout 66 with a central axis that is offset from the axis of container neck 16 and fitment wall 20. Annular wall 68 in this embodiment is flat rather than conical, and is oriented at an angle with respect to the axes of fitment wall 20 and spout 66. A drain-back opening 70 is disposed in wall 66 between spout 66 and fitment wall 20.

All three embodiments of the present invention share the feature whereby the closure and fitment may be provided as a sub-assembly to the product packager separately from the container. The container may be rapidly filled with product 80 (FIG. 5) through the relatively large opening provided by container neck 16, and the closure/fitment sub-assembly may then be rapidly assembled to the container neck by orienting slot 36 in alignment with lug 46, and then press-fitting fitment 18, 54 or 64 into the container neck until slot 36 registers with and is received over lug 46 on container neck 16. In each embodiment, press-fit insertion of the fitment is limited by abutment of shoulders 42, 44. In each embodiment, neck lug 46 cooperates with fitment slot 36 to align the dispensing opening or dispensing spout with respect to the container, retain the fitment in the container, and restrain rotation of the fitment within the container neck as the closure is either loosened or tightened. In all embodiments, container 12, closure 24, and fitment 18, 54 or 64 may be of any suitable plastic compositions. The container, fitment and closure may be formed by suitable conventional techniques, such as by injection molding the closure, fitment and container neck, and blow-molding the container body integrally with the container neck.

What is claimed is:

1. A container assembly that comprises:

a container having a body with a cylindrical neck and a lug projecting radially inwardly from said neck, and a fitment having a cylindrical wall received within said neck, said wall having an axial slot received over said lug, and said fitment having means within said wall for dispensing product from within said container body, such that said lug on said neck cooperates with said slot in said fitment wall for retaining said fitment within said neck, orienting said dispensing means with respect to said container body and preventing circumferential rotation of said fitment within said neck.

2. The container assembly set forth in claim 1 wherein said fitment further includes an annular wall extending radially inwardly from an end of said cylindrical wail, said dispensing means being carried by said annular wall.

3. The container assembly set forth in claim 2 wherein said annular wall is conical, tapering narrowingly in assembly into said container body.

4. The container assembly set forth in claim 3 wherein said dispensing means comprises a keyhole-shaped opening in said annular wall having a central circular portion and a radial portion that extends from said central portion to said cylindrical wall.

5. The container assembly set forth in claim 4 wherein said fitment has internal threads that are interrupted in alignment with said radial portion of said opening.

6. The container assembly set forth in claim 2 wherein said dispensing means comprises a conical pour spout extending axially from said annular wall within said cylindrical wall.

7. The container assembly set forth in claim 6 wherein said spout is coaxial with said cylindrical wall.

8. The container assembly set forth in claim 6 wherein said spout has a central axis that is offset from said cylindrical wall.

9. The container assembly set forth in claim 1 wherein said cylindrical neck wall has an axially facing internal shoulder, and said fitment has an axially facing external shoulder that seats in assembly against said internal neck shoulder.

10. The container assembly set forth in claim 1 wherein said fitment wall has internal threads, and said assembly further comprises a cup-shaped cap having external threads threaded into said fitment.

11. The container assembly set forth in claim 1 wherein said lug and said slot are U-shaped, each having parallel side edges and a rounded bottom edge.

12. A method of constructing and filling a package assembly that comprises the steps of:

(a) providing a container having a hollow body, an opening surrounded by a cylindrical neck and a lug projecting radially inwardly from said neck, (b) providing a fitment having a cylindrical wall adapted to be received by snap fit within said neck and having internal threads for receiving a cap, an annular wall extending radially inwardly from an end of said cylindrical wall, dispensing means carried by said annular wall and an axial slot in said cylindrical wall, (c) providing a cup-shaped cap having external threads, (d) threading said cap into said fitment to form a cap/fitment subassembly, (e) filling the container with product through said opening, and then (f) assembling said cap/fitment subassembly to the container neck by fitting said slot over said lug such that said lug cooperates with said slot for retaining said fitment within said neck, orienting said dispensing means with respect to said container body and preventing circumferential rotation of said fitment with respect to said neck, and such that the fitment is received and retained by snap fit on the container neck, and the fitment and cap seal the container opening at said neck.

13. The method set forth in claim 12 wherein said annular wall is conical, tapering narrowingly in assembly into said container body.

14. The method set forth in claim 13 wherein said dispensing means comprises a keyhole-shaped opening in said annular wall having a central circular portion and a radial portion that extends from said central portion to said cylindrical wall.

15. The method set forth in claim 14 wherein said fitment has internal threads that are interrupted in alignment with said radial portion of said opening.

16. The method set forth in claim 12 wherein said dispensing means comprises a conical pour spout extending axially from said annular wall within said cylindrical wall.

17. The method set forth in claim 12 wherein said cylindrical neck wall has an axially facing internal shoulder, and said fitment has an axially facing external shoulder that seats in assembly against said internal neck shoulder.

18. The method set forth in claim 12 wherein said lug and said slot are U-shaped, each having parallel side edges and a rounded bottom edge.

19. A fitment for securement to container having a body with a cylindrical neck and a lug projecting radially inwardly from said neck, said fitment comprising:

a cylindrical wall having an axial slot for receipt over said lug within the container neck, and having means within said wall for dispensing product from within the container body, such that said slot in said fitment wall with the lug on the neck cooperates for retaining said fitment within the neck, orienting said dispensing means with respect to the container body and preventing circumferential rotation of said fitment within said neck.

20. The fitment set forth in claim 1 further including an annular wall extending radially inwardly from an end of said cylindrical wall, said dispensing means being carried by said annular wall.

21. The fitment set forth in claim 20 wherein said annular wall is conical, tapering narrowingly in assembly into the container body.

22. The fitment set forth in claim 21 wherein said dispensing means comprises a keyhole-shaped opening in said annular wall having a central circular portion and a radial portion that extends from said central portion to said cylindrical wall.

23. The fitment set forth in claim 22 wherein said fitment has internal threads that are interrupted in alignment with said radial portion of said opening.

24. The fitment set forth in claim 21 wherein said dispensing means comprises a conical pour spout extending axially from said annular wall within said cylindrical wall.

25. The fitment set forth in claim 24 wherein said spout is coaxial with said cylindrical wall.

26. The fitment set forth in claim 24 wherein said spout has a central axis that is offset from said cylindrical wall.

27. The fitment set forth in claim 19 wherein said fitment has an axially facing external shoulder for seating in assembly against an internal neck shoulder on the container.

28. The fitment set forth in claim 19 wherein said fitment wall has internal threads, and a cup-shaped cap having external threads is threaded into said fitment.

29. The fitment set forth in claim 19 wherein said slot is U-shaped, each having parallel side edges and a rounded bottom edge.

30. A closure and fitment assembly for a container having a body with a cylindrical neck and a lug projecting radially inwardly from said neck, said assembly comprising a fitment having a cylindrical wall having an axial slot for receipt over said lug within said neck and having an internal thread and means within said wall for dispensing product from within said container body, and a cup-shaped cap having external threads threaded into said fitment.

31. The assembly set forth in claim 30 wherein said fitment has an axially facing external shoulder for seating in assembly against an internal neck shoulder on the container.

32. The assembly set forth in claim 30 wherein said slot is U-shaped, each having parallel side edges and a rounded bottom edge.

* * * * *